US007927110B1

(12) United States Patent
Zhu

(10) Patent No.: US 7,927,110 B1
(45) Date of Patent: Apr. 19, 2011

(54) CONNECTOR CLIP

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/804,987

(22) Filed: Aug. 2, 2010

(30) Foreign Application Priority Data

Dec. 30, 2009 (CN) ..... 2009 2 0318934

(51) Int. Cl.
*H01R 12/00* (2006.01)

(52) U.S. Cl. ..... 439/67; 439/493

(58) Field of Classification Search ..... 439/67, 439/493

See application file for complete search history.

(56) References Cited

U.S. PATENT DOCUMENTS

| | | | | |
|---|---|---|---|---|
| 4,169,641 | A * | 10/1979 | Olsson | 439/493 |
| 4,634,195 | A * | 1/1987 | Shoemaker | 439/493 |
| 7,238,032 | B2 * | 7/2007 | Pabst et al. | 439/67 |
| 2008/0233793 | A1 * | 9/2008 | Ju | 439/493 |

* cited by examiner

*Primary Examiner* — Tho D Ta
(74) *Attorney, Agent, or Firm* — Wei Te Chung; Andrew C. Cheng; Ming Chieh Chang

(57) ABSTRACT

A connector clip adapted for holding a flat cable directly against a printed circuit board (PCB) includes a pair of vertical walls mounted on the PCB with a width same to the flat cable, a pair of horizontal walls extending inwards from the vertical walls to commonly define a receiving room to receive the flat cable with a front opening from which the flat cable is inserted and a pressing cover disposed between the pair of horizontal walls in a horizontal plane. The pressing cover slants upwards to the front opening and has a pair of locking tabs bending to the front opening. The pressing cover is moved into the receiving room to press against the flat cable and the locking tabs interlock with the horizontal walls to block the pressing cover from moving away from the receiving room so that the flat cable is fitly retained in the receiving room.

11 Claims, 5 Drawing Sheets

CONNECTOR CLIP

BACKGROUND OF THE INVENTION

1. Field of the Invention

The present invention relates to a connector clip for a flat cable for connecting the flat cable to conductors on a circuit board.

2. Description of Related Art

U.S. Pat. No. 4,169,641 discloses a connector clip for a flat cable for connecting the conductors of a flat conductor cable to conductors on a circuit board. The connector clip comprises a single one-piece stamped and formed device which holds the cable conductors directly against the circuit board conductors. The connector clip comprises a flat clip member having parallel spaced-apart coplanar support strips and a clip bar which extends between the support strips in a plane which is offset from the plane of the support strips. A plurality of cantilever springs extends from the clip bar obliquely towards and past the plane of the support strips. These cantilever springs are located between the support strips, the spacing between the springs being the same as the spacing between the cable conductors and the circuit board conductors. The connector clip is mounted on the circuit board in straddling relationship to the circuit board conductors with the cantilever springs in alignment with the circuit board conductors. The end of the flat conductor cable is inserted beneath the clip bar and pushed parallel to the springs and the support strips until the cable is beneath the free ends of the springs and the cable conductors are against the circuit board conductors. The springs bear against the insulated top surface of the cable so that the circuit board conductors and the cable conductors are pressed against each other to establish electrical contact. As known, a large exterior force is used to insert the flat cable below the spring bear, which might result in a harm to the flat cable.

Therefore, an improved connector clip is desired to overcome the disadvantages of the prior arts.

SUMMARY OF THE INVENTION

An object of the present invention is to provide a connector clip for facility insertion of a flat cable.

In order to achieve above-mentioned object, a connector clip is adapted for holding a flat cable directly against a printed circuit board (PCB), the clip comprises a pair of vertical walls mounted on the PCB with a width same to the flat cable, a pair of horizontal walls extending inwards from the vertical walls to commonly define a receiving room to receive the flat cable with a front opening from which the flat cable is inserted and a pressing cover disposed between the pair of horizontal walls in a horizontal plane. The pressing cover slants upwards to the front opening and has a pair of locking tabs bending to the front opening. The pressing cover is moved into the receiving room to press against the flat cable and the locking tabs interlock with the horizontal walls to block the pressing cover from moving away from the receiving room so that the flat cable is fitly retained in the receiving room.

Other objects, advantages and novel features of the present invention will become more apparent from the following detailed description of the present embodiment when taken in conjunction with the accompanying drawings.

DETAILED DESCRIPTION OF THE INVENTION

Figure 1:
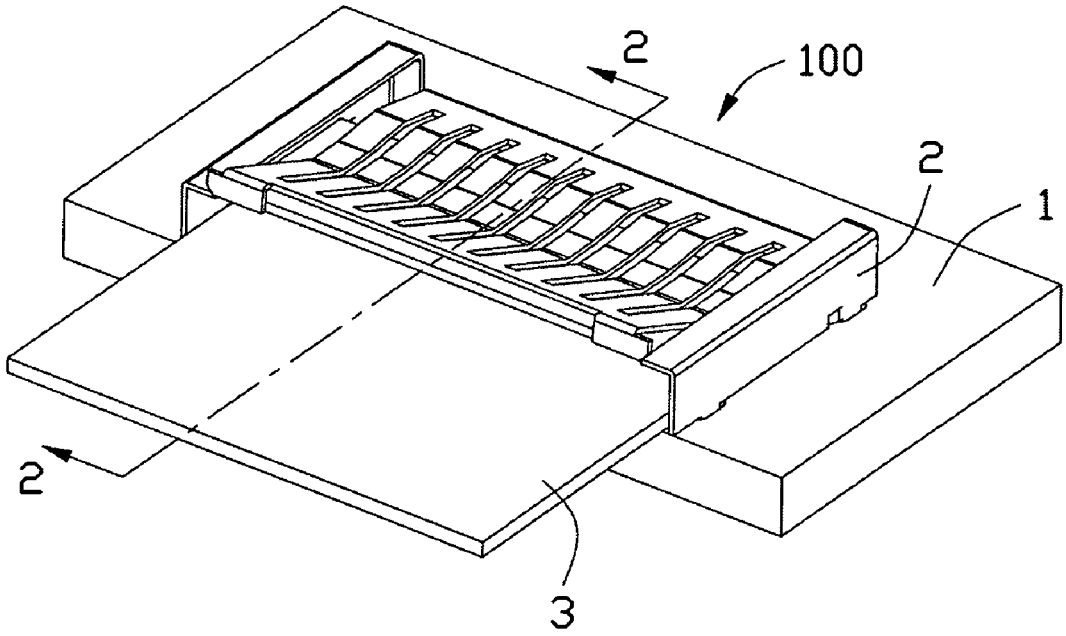
FIG. 1 is a perspective view of a connector clip assembly in accordance with the present invention.

Reference will now be made to the drawing figures to describe the preferred embodiment of the present invention in detail.

Figure 2:
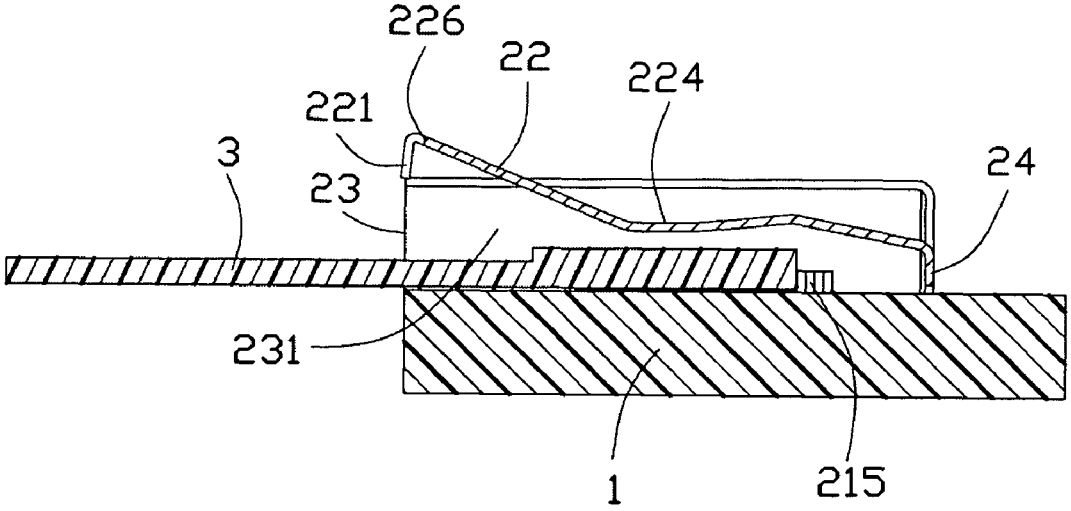
FIG. 2 is a cross-sectional view of FIG. 1 taken along line -2.
Figure 3:
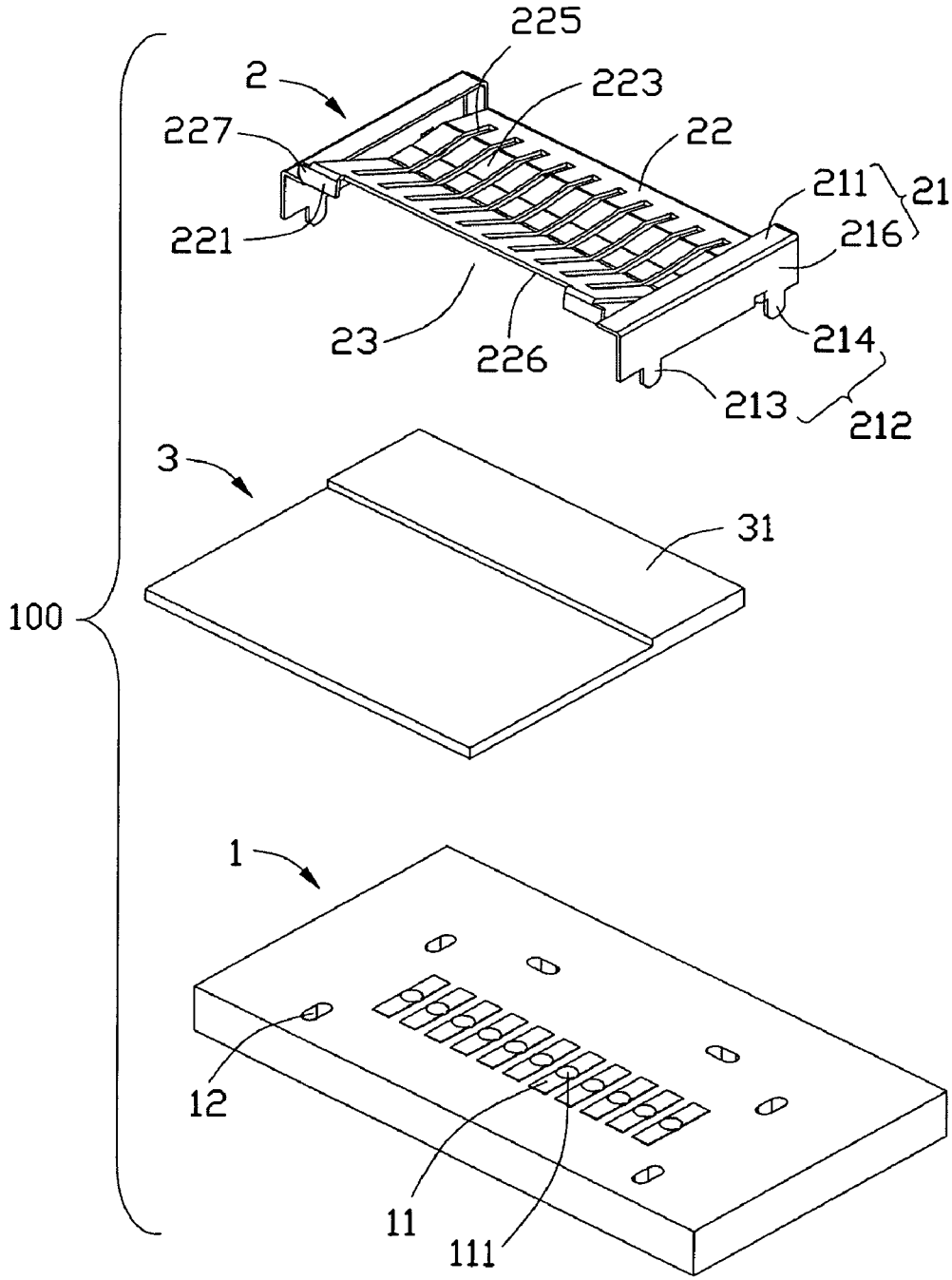
FIG. 3 is an exploded perspective view of the connector clip assembly shown in FIG. 1.

A connector clip 2 of a connector clip assembly 100 in accordance with the invention serve to connect a flat cable 3 to conducting pads 11 of a panel-like member, such as printed circuit board (PCB) 1. As shown in FIGS. 2&3, the cable 3 has a large header portion 31 which will inserted into the connector clip 2 and contains a plurality of flat conductors which are within a film of insulating material such as a polyester film (not shown in Figures). The PCB 1 has a plurality of conducting pads 11 on an upper surface thereof in one row and each pad has an upward boss 111 at a middle portion thereof. Three pairs of through holes 12 are defined in the vicinity of the row of the pads 11.

The connector clip 2 is stamped from a metallic sheet and includes a pair of sidewall 21 and a pressing cover 22 disposed between the pair of sidewalls to commonly define a receiving room 231 opening forwards with a front opening 23. The sidewalls include vertical wall 216 and horizontal walls 211 extending from the vertical walls and spaced from each other. The lateral distance between the vertical walls 216 is same to the flat cable 3 in width and cooperates with the horizontal walls 216 to define the receiving room 231. A rear wall 24 is provided opposite to the front opening 23, which unitarily connects with the sidewall 21 at two opposite ends thereof. The pressing cover 22 unitarily extends from the top edge of the rear wall 24. The width of the pressing cover is equal to or smaller than the spaced distance between the pair of the horizontal walls 211 in a horizontal plane so that the pressing cover 22 can shift into and out the receiving room 231 in a vertical direction parallel to the vertical walls 216.

Two connecting legs 213, 214 further extend downwards from each vertical wall 216 intended to be inserted in the through holes 12 and the rear wall 24 can also extends corresponding connecting legs to be retained in the PCB. The first connecting legs 213 are near to the front opening 23 and the second connecting legs 214 are near to the rear wall. A stopping tab 215 bend inwards to the receiving room 231 to from the vertical wall 216 near the second leg 214, which is used to limit the insertion depth of the flat cable 3 in the receiving room 231 as best shown in FIG. 2.

Figure 4:
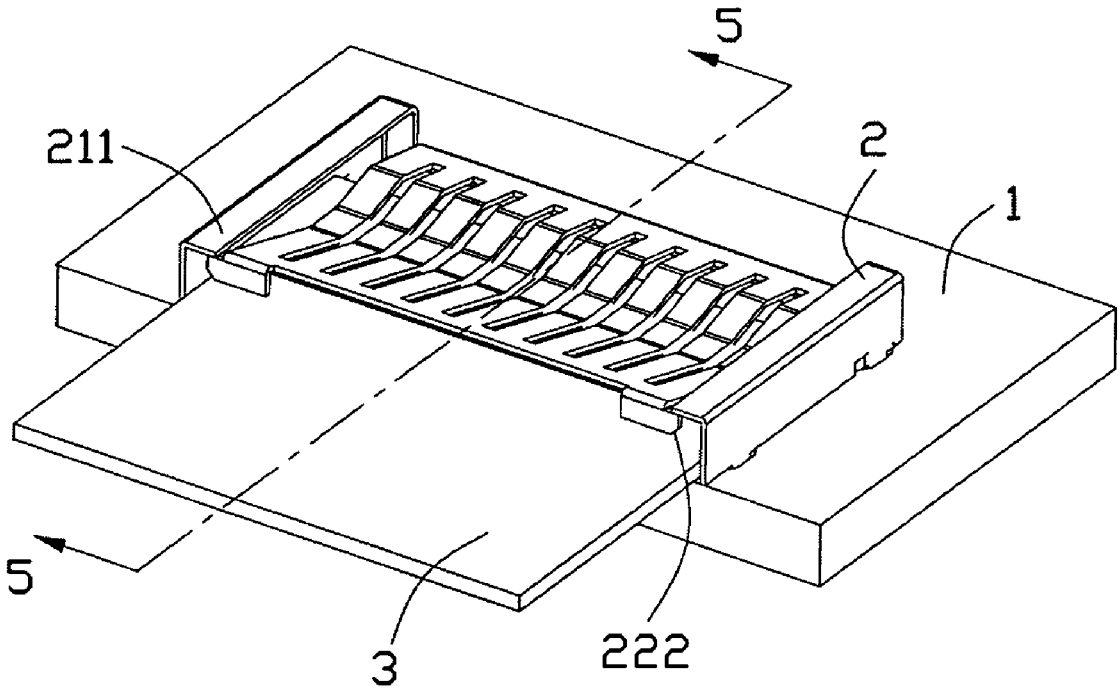
FIG. 4 is a perspective view of the connector clip assembly.
Figure 5:
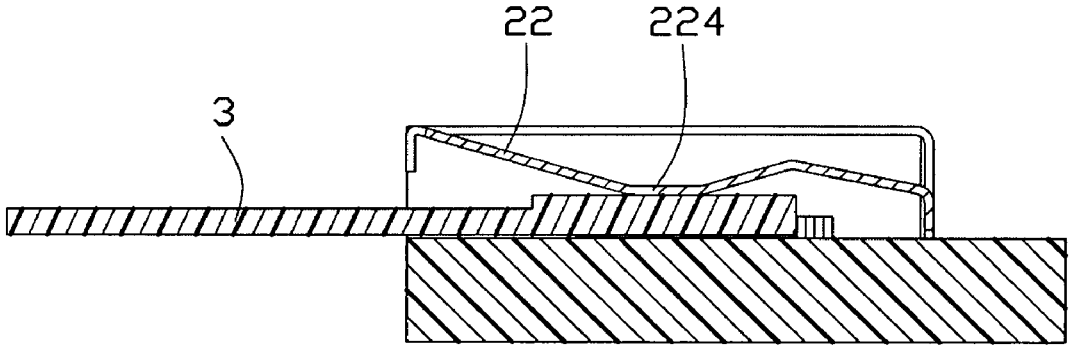
FIG. 5 is a cross-sectional view of FIG. 4 taken along line 5-5.

The pressing cover 22 unitarily bends from the rear wall 24 towards the front opening 23, which slants upwards. The middle portion of the pressing portion 22 protrudes into the receiving room 231 than other portion to form a pressing portion 224 which will press against the flat cable as shown in FIG. 5. The front portion of the pressing portion sharply slants than the middle portion and the rear portion of the pressing portion, as a result the front edge 226 of the pressing portion is located above the horizontal wall 216 while most of the pressing portion is below the horizontal walls 211. A pair of locking tabs 221 bends vertically to the front opening 23 from two opposite ends of the front edge 226 of the pressing cover 22 and each has a lateral end 227 exceeding the lateral edge of the pressing cover 22 to stagger with the horizontal walls 211. A chamfer 222 labeled in FIG. 4 is defined at an outside of each lateral end 227 to guide the locking tab 221 to pass over the horizontal walls. The pressing cover 22 further define a plurality of slot 225 extending in the inserting direction of the flat cable 3 and arranged between the horizontal wall 211 to from a plurality of elastic ribs 223, which do not penetrate the front edge 226 and rear edge of the pressing cover so that the pressing cover 22 has a better elasticity.

The connector clip 2 is mounted on the PCB 1 by said connecting legs, the vertical walls 216 are perpendicular to the PCB and the horizontal walls are parallel to the PCB. Please note the definition of vertical and horizontal is relative to the PCB 1.

The flat cable 3 is inserted in the receiving room 231 in a condition that the pressing cover 22 is in a free statute wherein the pressing portion 224 spaces from the PCB with a larger height than the thickness of the flat cable 3 so that the flat cable 3 can be inserted with a zero force. The metallic pressing cover 22 do not touch the conductive pads 111 to avoid a short circuit. Then, the locking tabs 221 are pushed downwards to pass over the outward deformed horizontal walls 221 especially guiding by the chambers 222. The lateral ends 227 abut against the underside of the restored horizontal walls to limit the pressing cover 22 from upward shifting. Thus the flat cable 3 is fitly retained in the receiving room 231. The receiving room 231 opens to the PCB 1 at one side and covered by the pressing cover at another opposite side thereof so that the flat cable stably and directly contact with upward bosses 111 of the conductive pads 11 by the pressing of the pressing cover 22.

The connector clip 2 is made from metal material in this embodiment, especial from a metal sheet to ensure a good spring characteristics. Alternatively, the clip can be formed of a suitable material only ensure the clip keep a good spring characteristics.

However, the disclosure is illustrative only, changes may be made in detail, especially in matter of shape, size, and arrangement of parts within the principles of the invention.

What is claimed is:

1. A connector clip adapted for holding a flat cable directly against a printed circuit board (PCB), comprising:

a pair of vertical walls mounted on the PCB with a width same to the flat cable and a pair of horizontal walls extending inwards from the vertical walls to commonly define a receiving room to receive the flat cable with a front opening from which the flat cable is inserted;

a pressing cover disposed between the pair of horizontal walls in a horizontal plane, the pressing cover slanting upwards to the front opening and having a pair of locking tabs bending to the front opening; wherein the pressing cover is moved into the receiving room to press against the flat cable and the locking tabs interlock with the horizontal walls to block the pressing cover from moving away from the receiving room so that the flat cable is fitly retained in the receiving room;

wherein the pressing cover has a press portion substantial at a middle portion thereof, which bends further in the receiving room than other portion thereof;

wherein a front edge of the pressing cover is located above the horizontal walls in a free stature of pressing cover and the pressing portion spaces from the PCB with a distance larger than the flat cable.

2. The connector clip as described in claim 1, wherein the vertical walls extend a stopping tab inwards to the receiving room to limit an insertion depth of the flat cable.

3. The connector clip as described in claim 1, further comprising a rear wall opposite to the front opening and mounted on the PCB, the pressing cover extending from the rear wall.

4. The connector clip as described in claim 3, wherein the pair of locking tabs bending vertically from a front edge of two opposite ends of the pressing cover and extend laterally to stagger with the horizontal walls.

5. The connector clip as described in claim 4, wherein the pressing cover has a plurality of slots extending in an inserting direction of the flat cable and arranged between the horizontal walls.

6. The connector clip as described in claim 5, wherein the slots do not penetrate through the front edge and a rear edge of the pressing cover.

7. The connector clip as described in claim 1, wherein the locking tabs have lateral ends extending outwards beyond the horizontal walls so that the lateral ends can abut against an underside of the lateral ends.

8. The connector clip as described in claim 7, wherein each lateral end has a chamber at an outside edge thereof.

9. An electrical assembly comprising:

a printed circuit board defining a contact area;

a clip including a pair of side walls fastened to the printed circuit board on said contact area, a pressing cover being resilient relative to the side walls between high and low positions, and cooperating with said pair of side walls to define a receiving room for receiving a flat type cable with a front opening from which the flat type cable is inserted, wherein the flat type cable has electrodes thereon for electrically connecting to corresponding circuit traces on the printed circuit board;

wherein in the high position, said pressing cover is essentially of a cantilevered manner with a fixed end around a rear region to define a higher receiving room for allowing the corresponding flat type cable to be inserted into the receiving room in a zero force manner, while in the low position the pressing cover is analogous to a simply supported manner with an additional holding end around a front region to define a lower receiving room for firmly downwardly pressing the corresponding flat type cable after the flat type cable is inserted into the receiving room;

wherein the pressing cover defines two opposite lateral ends bending to the front opening to latch to the corresponding side walls when the pressing cover is in the low position.

10. The electrical assembly as claimed in claim 9, wherein the flat type cable is adapted to be directly connected to the corresponding circuit traces on the printed circuit board.

11. The electrical assembly as claimed in claim 9, wherein the pressing cover is not flat but either curved and angled around a middle region in a front-to-back direction.

* * * * *